US006660088B2

(12) United States Patent
Negishi et al.

(10) Patent No.: US 6,660,088 B2
(45) Date of Patent: Dec. 9, 2003

(54) PRESSURE INFILTRATING APPARATUS FOR INFILTRATING FIBER BUNDLE WITH METAL

(75) Inventors: Satoshi Negishi, Shizuoka (JP); Takeshi Kamata, Shizuoka (JP); Eiji Murofushi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/940,536

(22) Filed: Aug. 29, 2001

(65) Prior Publication Data

US 2002/0040680 A1 Apr. 11, 2002

(30) Foreign Application Priority Data

Aug. 29, 2000 (JP) ..... P.2000-259544

(51) Int. Cl.[7] ..... B05C 3/02
(52) U.S. Cl. ..... 118/405; 118/50; 118/420
(58) Field of Search ..... 118/405, 509, 118/420, 64–68; 164/97, 98, 269, 268, 461; 427/431, 432, 434.6, 434.7

(56) References Cited

U.S. PATENT DOCUMENTS 4,242,368 A * 12/1980 Nagai et al.
4,948,406 A * 8/1990 Kornmann
5,736,199 A 4/1998 Blucher
6,035,925 A 3/2000 Blucher
2002/0000302 A1 * 1/2002 Blucher et al.

FOREIGN PATENT DOCUMENTS

EP 1 143 028 A1 10/2001
JP 1-145352 6/1989
JP 4176851 * 6/1992
JP 6-158197 6/1994 ..... C22C/1/09

OTHER PUBLICATIONS

Patent Abstracts of Japan 06–158197, Jun. 7, 1994.

* cited by examiner

*Primary Examiner*—Brenda A. Lamb
(74) *Attorney, Agent, or Firm*—Sughrue Mion, PLLC

(57) ABSTRACT

In a pressure infiltrating apparatus 20 according to the invention, an upper end of an inlet side orifice 23 in the drawing is formed to take a tapered convex shape and a lower end of an insertion hole of an intermediate orifice 25 in the drawing is formed to take a concave shape having a diameter gradually increased corresponding to the convex shape of the inlet side orifice 23. Consequently, a space A between the inlet side orifice 23 and the intermediate orifice 25 is set to be small without damaging the fluidity of a molten metal 11 between the inlet side orifice 23 and the intermediate orifice 25 in a bath container 22.

2 Claims, 3 Drawing Sheets

PRESSURE INFILTRATING APPARATUS FOR INFILTRATING FIBER BUNDLE WITH METAL

BACKGROUND OF INVENTION

1. Field of Invention

The present invention relates to a pressure infiltrating apparatus for infiltrating a fiber bundle with a metal to manufacture a fiber reinforced metal composite wire having a fiber bundle infiltrated with a molten metal and an outer surface of the fiber bundle coated with the metal, and more particularly to an orifice structure of the pressure infiltrating apparatus for positioning the fiber bundle around the fiber reinforced metal composite wire.

2. Related Art

Conventionally, a fiber reinforced metal composite wire is used as an electric wire excellent in durability and reliability. The fiber reinforced metal composite wire is obtained by infiltrating an inorganic fiber bundle such as a carbon fiber, a ceramic fiber or a metal fiber with a molten metal and the amount of the molten metal held on the inorganic fiber bundle is increased so that the durability and reliability can be more enhanced.

Conventionally, U.S. Pat. No. 5,736,199 has described a method of manufacturing a fiber reinforced metal composite wire for holding more molten metals in the fiber bundle in which the metal is infiltrated in a fiber of the inorganic fiber bundle at a predetermined pressure. The manufacturing method is carried out by using a metal infiltrating apparatus 30 shown in FIG. 3.

Referring to FIG. 3, in a metal infiltrating apparatus 30, an inorganic fiber bundle 37 to be inserted in a pressure chamber 31 and a bath container 32 is immersed in a molten metal 33 stored in the bath container 32 through orifices 34, 35 and 36 in the pressure chamber 31 filled with an inert gas, thereby infiltrating the inorganic fiber bundle 37 with a metal and coating the outer surface of the inorganic fiber bundle 37 with the metal.

The orifices 34, 35 and 36 include the entering orifice 34 for inserting the inorganic fiber bundle 37 from the outside of the pressure chamber 31 on the fiber bundle inlet side into the bath container 32, the exit orifice 35 for inserting the inorganic fiber bundle 37 from the inside of the pressure chamber 31 to the outside of the pressure chamber 31 on the fiber bundle outlet side, and the intermediate orifice 36 provided between the entering orifice 34 and the exit orifice 35 and serving to insert the inorganic fiber bundle 37 from the bath container 32 into the pressure chamber 31.

In the conventional metal infiltrating apparatus 30, in the case in which the fiber reinforced metal composite wire is to be thinned, there is a possibility that the inorganic fiber bundle 37 might be flexed or moved between the entering orifice 34 and the intermediate orifice 36 in the bath container 32.

Accordingly, there is a problem in that it is hard to concentrically coat the periphery of the inorganic fiber bundle 37 with a metal and to position the inorganic fiber bundle 37 on the center of the coating metal, that is, the center of the fiber reinforced metal composite wire.

SUMMARY OF THE INVENTION

The invention has an object to provide a pressure infiltrating apparatus for infiltrating a fiber bundle with a metal which can reduce a space between an inlet side orifice and an intermediate orifice, thereby reliably preventing such a drawback that a fiber bundle is flexed between the inlet side orifice and the intermediate orifice in a bath container and arranging the fiber bundle on the center of a coating metal.

The problem of the invention can be solved by a pressure infiltrating apparatus for inserting a fiber bundle through an orifice in a molten metal stored in a bath container in a pressure chamber filled with an inert gas, thereby infiltrating the fiber bundle with the molten metal and coating an outer surface of the fiber bundle with the molten metal, wherein the orifice includes an inlet side orifice for inserting the fiber bundle from a fiber bundle inlet side of the pressure chamber into the bath container, an outlet side orifice for leading a fiber reinforced metal composite wire infiltrated with the molten metal from a fiber bundle outlet side of the pressure chamber to an outside of the pressure chamber, and an intermediate orifice provided between the inlet side orifice and the outlet side orifice and serving to insert the fiber reinforced metal composite wire from the bath container into the pressure chamber, and a tip shape on the intermediate orifice side of the inlet side orifice is caused to be convex and an inside shape of a tip on the inlet side orifice side of the intermediate orifice is caused to be concave corresponding to the tip shape of the inlet side orifice.

According to the pressure infiltrating apparatus for infiltrating a fiber bundle with a metal which has the structure described above, the tip shape on the intermediate orifice side of the inlet side orifice is caused to be convex and the tip shape of an insertion hole on the inlet side orifice side of the intermediate orifice is caused to be concave corresponding to the tip shape of the inlet side orifice.

Accordingly, the fiber bundle is inserted into the bath container through the inlet side orifice and is caused to come in contact with a molten metal in the bath container under pressurization of the inert gas from the inlet side orifice to the intermediate orifice. Consequently, the fiber bundle is infiltrated with the molten metal and the outer surface thereof is coated with the molten metal.

In this case, the space between the inlet side orifice and the intermediate orifice is reduced so that the fiber bundle can be reliably prevented from being flexed between the inlet side orifice and the intermediate orifice in the bath container and the fiber bundle can be positioned on the center of the coating metal.

Moreover, the fiber bundle is simply exposed to the molten metal in a minimum time required for the infiltration and coating of the molten metal so that the damage to the fiber bundle caused by a reaction to the molten metal can be relieved.

In the case in which the space between the inlet side orifice and the intermediate orifice is reduced, there is a possibility that the fluidity of the molten metal between the inlet side orifice and the intermediate orifice might be deteriorated and the infiltration might not be carried out sufficiently. However, since the tip shape on the intermediate orifice side of the inlet side orifice is convex and the tip shape on the inlet side orifice side of the intermediate orifice is concave corresponding to the shape of the inlet side orifice, the fluidity of the molten metal between the inlet side orifice and the intermediate orifice can be ensured and the infiltration into the fiber bundle can be carried out sufficiently.

Moreover, the fiber bundle infiltrated and coated with the molten metal is inserted from the intermediate orifice into the pressure chamber. The fiber bundle in the pressure chamber is led out of the pressure chamber through the outlet side orifice after the molten metal with which the fiber bundle is infiltrated and coated is cooled.

DETAILED DESCRIPTION OF PREFERRED EMBODIMENTS

Figure 1:
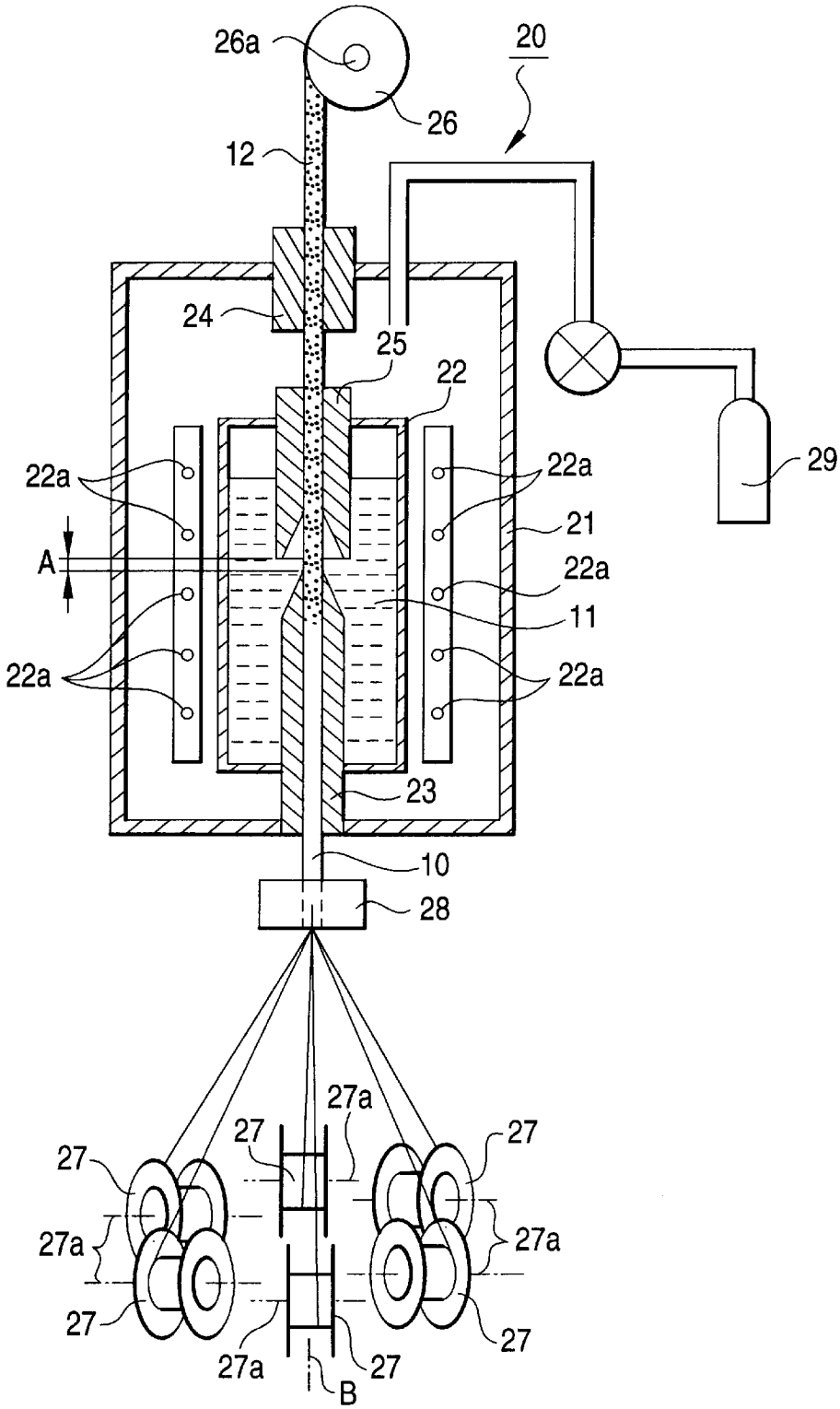
FIG. 1 is a schematic sectional view showing an embodiment of a pressure infiltrating apparatus for infiltrating a fiber bundle with a metal according to the invention.

An embodiment of a pressure infiltrating apparatus for infiltrating a fiber bundle with a metal according to the invention will be described below with reference to FIGS. 1 and 2. FIG. 1 is a schematic sectional view showing the pressure infiltrating apparatus for infiltrating a fiber bundle with a metal according to the embodiment of the invention, and FIG. 2 is a sectional view showing a fiber reinforced metal composite wire formed by the pressure infiltrating apparatus in FIG. 1.

Figure 2:
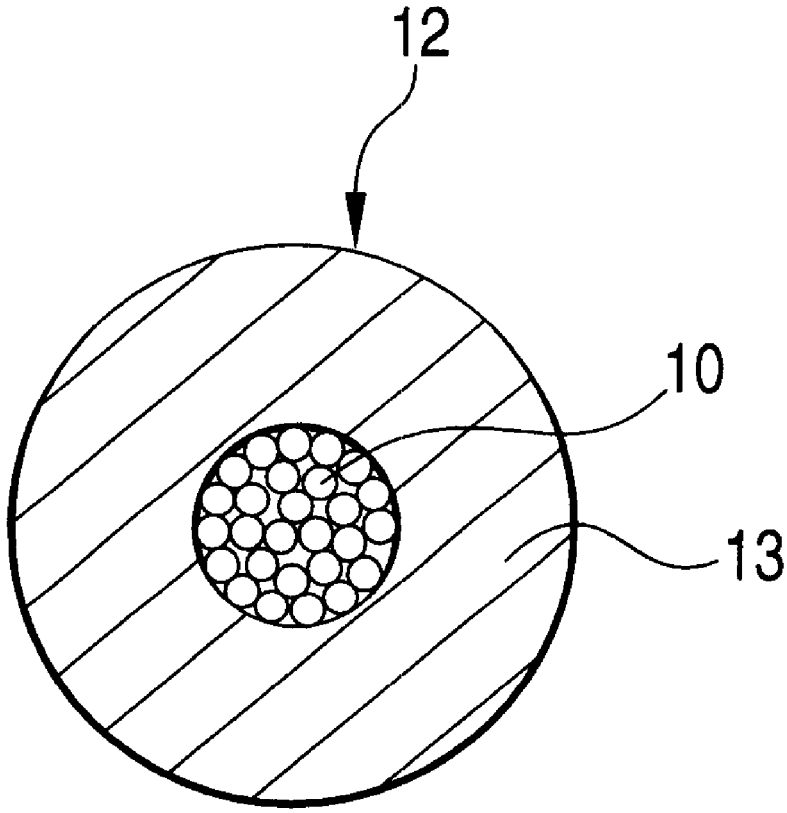
FIG. 2 is a sectional view showing a fiber reinforced metal composite wire formed by the pressure infiltrating apparatus in FIG. 1.
Figure 3:
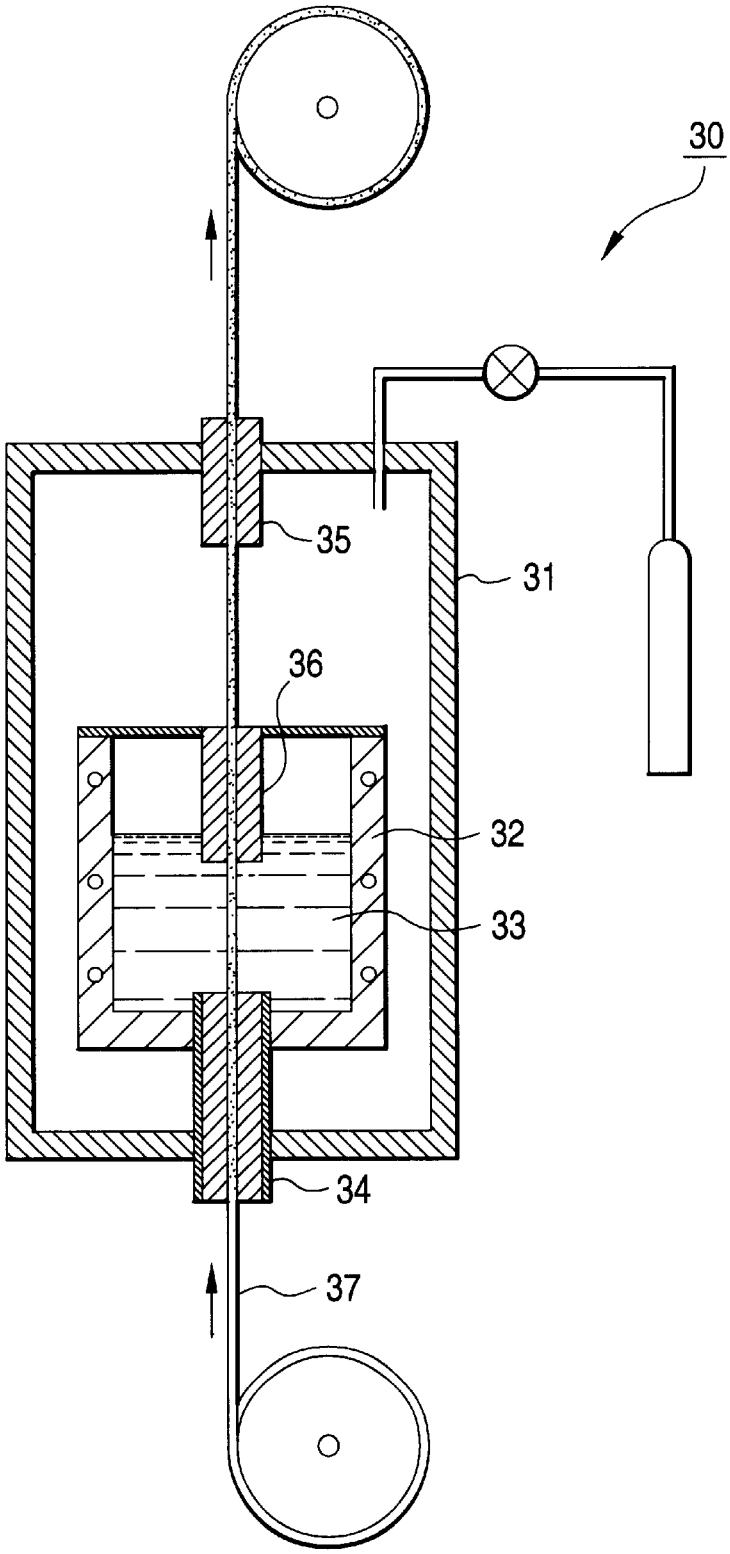
FIG. 3 is a schematic sectional view showing a conventional pressure infiltrating apparatus.

As shown in FIGS. 1 and 2, a pressure infiltrating apparatus 20 according to the embodiment immerses an inorganic fiber bundle 10 to be inserted into a pressure chamber 21 and a bath container 22 through orifices 23, 24 and 25 in molten metal 11 stored in the bath container 22 in the pressure chamber 21 filled with an inert gas. Consequently, the inorganic fiber bundle 10 is infiltrated with the metal and the outer surface thereof is coated with the metal so that a fiber reinforced metal composite wire 12 is formed.

More specifically, in the pressure infiltrating apparatus 20, the inorganic fiber bundle 10 is continuously fed from each feeding side drum 27 upward in FIG. 1 with the rotation of a winding side drum 26 and is converged through a throttling portion 28 such as a die, and is inserted into the pressure chamber 21 and the bath container 22 through each of the orifices 23, 24 and 25. Consequently, the pressure infiltrating apparatus 20 immerses the inorganic fiber bundle 10 in the molten metal 11 at a predetermined pressure, and impregnates the inorganic fiber bundle 10 with the metal and concentrically coats the outer surface of the inorganic fiber bundle 10 with the metal. Examples of the inorganic fiber include a fiber such as carbon, boron or silicon carbide and a metal fiber such as aluminum oxide.

Moreover, an inert gas such as argon, nitrogen or helium is supplied from a gas supply source 29 to the pressure chamber 21 to be filled at a predetermined pressure.

Furthermore, the bath container 22 is provided in the pressure chamber 21 and stores the molten metal 11 such as copper, aluminum, magnesium, silver or alloys. A heater 22*a* is provided in the vicinity of the outer peripheral surface of the bath container 22. The heater 22*a* heats the molten metal 11 stored in the bath container 22 and keeps the molten metal 11 warm.

Moreover, the orifices 23, 24 and 25 include the inlet side orifice 23, the outlet side orifice 24 and the intermediate orifice 25. The inlet side orifice 23 inserts the inorganic fiber bundle 10 from the outside of the pressure chamber 21 on the inorganic fiber bundle inlet side (the lower side in FIG. 1) into the bath container 22. The outlet side orifice 24 inserts the inorganic fiber bundle 10 from the inside of the pressure chamber 21 to the outside of the pressure chamber 21 on the inorganic fiber bundle outlet side (the upper side in FIG. 1). The intermediate orifice 25 is provided between the inlet side orifice 23 and the outlet side orifice 24, and inserts the inorganic fiber bundle 10 from the inside of the bath container 22 to the inside of the pressure chamber 21.

The orifices 23, 24 and 25 are formed of at least one of graphite, tantalum, stainless, tungsten, inconel, molybdenum, platinum, sintered zirconia ceramic and an aluminum ceramics based material which less react to the molten metal 11 and the inorganic fiber bundle 10 mechanically and chemically. Consequently, the durability of the orifices 23, 24 and 25 themselves can be maintained and the inorganic fiber bundle 10 in the orifices 23, 24 and 25 can be prevented from being broken.

A tip (an upper end in FIG. 1) on the intermediate orifice 25 side in the inlet side orifice 23 is formed to take a conically tapered convex shape. Moreover, the tip portion (lower end in FIG. 1) of an insertion hole on the inlet side orifice 23 side in the intermediate orifice 25 is formed to take a conical concave shape having a diameter gradually increased toward the tip (lower end in FIG. 1) corresponding to the tapered convex shape of the inlet side orifice 23.

By the tapered convex shape on the upper end of the inlet side orifice 23 shown in FIG. 1 and the concave shape on the lower end of the insertion hole in the intermediate orifice 25 shown in FIG. 1, a space A between the inlet side orifice 23 and the intermediate orifice 25 can be set to be small without damaging the fluidity of the molten metal 11 between the inlet side orifice 23 and the intermediate orifice 25 in the bath container 22.

Accordingly, the inorganic fiber bundle 10 can be reliably prevented from being flexed between the inlet side orifice 23 and the intermediate orifice 25 in the bath container 22 and a time required for exposing the inorganic fiber bundle 10 to the molten metal 11 is minimized for the infiltration and coating of the metal. Moreover, the inserting property of the inorganic fiber bundle 10 can be maintained to be excellent.

Moreover, a plurality of (six in FIG. 1) feeding side drums 27 are provided on the outside of the pressure chamber 21 at the inlet side of the inorganic fiber bundle 10 through the inlet side orifice 23. Each of the feeding side drums 27 feeds the inorganic fiber bundle 10 wound around the outer periphery through rotation around a rotary shaft 27*a* and twists a plurality of (six in FIG. 1) inorganic fiber bundles 10 thus fed through revolution around a virtual center line B.

Furthermore, the winding side drum 26 is provided on the outside of the pressure chamber 21 at the outlet side of the inorganic fiber bundle 10 through the outlet side orifice 24. The winding side drum 26 winds the fiber reinforced metal composite wire 12 upon the outer periphery through rotation around a rotary shaft 26*a*.

Description will be given to the function of the pressure infiltrating apparatus for infiltrating a fiber bundle with a metal according to the embodiment. The inorganic fiber bundle 10 in the pressure infiltrating apparatus 20 is continuously fed from each feeding side drum 27 with the rotation of the winding side drum 26, is converged through the throttling portion 28 and is then introduced into the bath container 22 through the inlet side orifice 23.

The inorganic fiber bundle 10 in the bath container 22 is immersed in the molten metal 11 under the pressurization of the inert gas supplied from the gas supply source 29 while it gets out of the tip (upper end in FIG. 1) of the inlet side orifice 23 into the intermediate orifice 25.

Consequently, the inorganic fiber bundle 10 is infiltrated with the molten metal and the outer surface thereof is coated with the molten metal.

In this case, the space A between the inlet side orifice 23 and the intermediate orifice 25 is set to be small. Consequently, it is possible to reliably prevent the inorganic fiber bundle 10 from being flexed between the inlet side orifice 23 and the intermediate orifice 25 in the bath container 22.

Accordingly, the inorganic fiber bundle 10 is formed to be arranged on the center of a coating metal 13, that is, the center of the fiber reinforced metal composite wire 12. Moreover, the inorganic fiber bundle 10 is simply exposed to the molten metal 11 in a minimum time necessary for the infiltration and coating of the metal so that the damage to the inorganic fiber bundle 10 caused by a reaction to the molten metal 11 can be relieved.

In the case in which the space A between the inlet side orifice 23 and the intermediate orifice 25 is reduced, the fluidity of the molten metal 11 between the inlet side orifice 23 and the intermediate orifice 25 is deteriorated. Due to the deterioration in the fluidity of the molten metal 11, usually, the infiltration in the fiber bundle cannot be carried out sufficiently.

In the pressure infiltrating apparatus 20 according to the embodiment, however, the upper end of the inlet side orifice 23 in FIG. 1 takes a tapered convex shape and the lower end of the insertion hole in the intermediate orifice 25 in FIG. 1 takes a concave shape having a diameter gradually increased corresponding to the convex shape of the inlet side orifice 23. Consequently, it is possible to maintain the fluidity of the molten metal 11 between the inlet side orifice 23 and the intermediate orifice 25.

The inorganic fiber bundle 10 infiltrated and coated with the metal is inserted through the intermediate orifice 25 and an extra portion of the metal coating the outer surface is scraped off for molding, and the inorganic fiber bundle 10 is inserted from the intermediate orifice 25 into the pressure chamber 21. The molten metal 11 with which the inorganic fiber bundle 10 in the pressure chamber 21 is infiltrated and coated is cooled to form the fiber reinforced metal composite wire 12.

Then, the fiber reinforced metal composite wire 12 gets out of the pressure chamber 21 though the outlet side orifice 24 and is wound upon the winding side drum 26.

According to the pressure infiltrating apparatus for infiltrating a fiber bundle with a metal according to the embodiment, as described above, the upper end of the inlet side orifice 23 in FIG. 1 is formed to take the tapered convex shape and the lower end of the insertion hole of the intermediate orifice 25 in FIG. 1 is formed to take a concave shape having a diameter gradually increased corresponding to the convex shape of the inlet side orifice 23. Therefore, it is possible to set the space A between the inlet side orifice 23 and the intermediate orifice 25 to be small without damaging the fluidity of the molten metal 11 between the inlet side orifice 23 and the intermediate orifice 25 in the bath container 22.

Also in the case in which the fiber reinforced metal composite wire 12 is to be particularly thinned, accordingly, it is possible to reliably prevent the inorganic fiber bundle 10 from being flexed or moved between the inlet side orifice 23 and the intermediate orifice 25 in the bath container 22. Consequently, the periphery of the inorganic fiber bundle 10 can be concentrically coated with the metal and the inorganic fiber bundle 10 can be provided on the center of the coating metal 13, that is, the center of the fiber reinforced metal composite wire 12.

Moreover, a time required for exposing the inorganic fiber bundle 10 to the molten metal 11 can be minimized for the infiltration and coating of the metal, and the damage to the inorganic fiber bundle 10 caused by the reaction to the molten metal 11 can be minimized.

Consequently, it is possible to obtain the fiber reinforced metal composite wire 12 which is thinned with a light weight, a high mechanical strength, an excellent electrical characteristic and a high quality.

JP-A-6-158197 has disclosed an infiltrating apparatus for immersing a plurality of long fiber bundles in a molten metal, and infiltrating the fiber with the molten metal and converging the fiber in the molten metal in order to manufacture a composite material, which is not shown. In the infiltrating apparatus, the long fiber bundle is converged and the extra molten metal of the composite material is scraped off, and furthermore, the external shape of the composite material is molded through the throttle portion such as a nozzle provided in the molten metal.

In the infiltrating apparatus, the throttling portion such as a nozzle is provided in the molten metal, and it is hard to converge the fiber in the central part of the composite material and the outer surface is to be coated with a metal separately. More specifically, it is necessary to always maintain the tension of the fiber to be constant and to center the fiber on the throttling portion in order to converge the fiber on the central part of the composite material. However, the conventional publication has not described means for centering the fiber on the throttling portion.

It is technically hard to concentrically coat the fiber with a metal if the means for centering the fiber is not close to the center of the throttling portion. For this reason, it is hard to provide the means for centering the fiber in the infiltrating apparatus in which the throttle portion is provided in the molten metal.

According to the pressure infiltrating apparatus 20 in accordance with the embodiment, the problems of the conventional infiltrating apparatus can be solved, the inorganic fiber bundle 10 can be positioned on the center of the coating metal 13 and the fiber reinforced metal composite wire 12 having the inorganic fiber bundle 10 arranged on the center can be obtained.

According to the pressure infiltrating apparatus for infiltrating a fiber bundle with a metal in accordance with the invention, as described above, the tip shape on the intermediate orifice side of the inlet side orifice is caused to be convex and the inside shape of the tip on the inlet side orifice side of the intermediate orifice is caused to be concave corresponding to the tip shape of the inlet side orifice.

Accordingly, the space between the inlet side orifice and the intermediate orifice can be reduced, and it is possible to reliably eliminate such a drawback that the fiber bundle is flexed between the inlet side orifice and the intermediate orifice in the bath container and to arrange the fiber bundle on the center of the coating metal. Consequently, it is possible to obtain a fiber reinforced metal composite wire which is thinned with a light weight, a high mechanism strength, an excellent electrical characteristic and a high quality.

What is claimed is:

1. A pressure infiltrating apparatus comprising:

a fiber bundle passing through a molten metal stored in a bath container in a pressure chamber filled with an inert gas via orifice thereby infiltrating the fiber bundle with the molten metal and coating an outer surface of the fiber bundle with the molten metal, the orifice including:

an inlet side orifice for inserting the fiber bundle from a fiber bundle inlet side of the pressure chamber into the bath container;

an outlet side orifice for leading a fiber reinforced metal composite wire infiltrated with the molten metal from a fiber bundle outlet side of the pressure chamber to an outside of the pressure chamber; and an intermediate orifice provided between the inlet side orifice and the outlet side orifice and serving to insert the fiber reinforced metal composite wire from the bath container into the pressure chamber, wherein a tip of the intermediate orifice side of the inlet side orifice has a convex shape and a tip on the inlet side orifice side of the intermediate orifice has a concave shape corresponding to the convex shape of the tip of the inlet side orifice.

2. A pressure infiltrating apparatus as claimed in claim 1, wherein the inlet side orifice and intermediate orifice are spaced from each other by a predetermined value.

* * * * *